United States Patent [19]

Dührkoop

[11] Patent Number: 4,853,541

[45] Date of Patent: Aug. 1, 1989

[54] DEVICE FOR DETECTING THE SPATIAL ORIENTATION OF EXCESSIVELY HEATED POINTS

[75] Inventor: Jens Dührkoop, Heidelberg, Fed. Rep. of Germany

[73] Assignee: Voest-Alpine AG, Linz, Austria

[21] Appl. No.: 109,798

[22] Filed: Oct. 16, 1987

[30] Foreign Application Priority Data

Oct. 17, 1986 [AT] Austria ..... 2773/86

[51] Int. Cl.[4] ..... G01J 5/54

[52] U.S. Cl. ..... 250/347; 250/342; 246/169 D

[58] Field of Search ..... 246/169 A, 169 D; 250/347, 342, 338 R

[56] References Cited

U.S. PATENT DOCUMENTS 3,303,340 2/1967 Hewett et al. ..... 246/169 D 3,617,745 11/1971 Reed ..... 250/347

4,057,734 11/1977 Barringer ..... 250/345

*Primary Examiner*—Carolyn E. Fields

*Attorney, Agent, or Firm*—Peter E. Rosden

[57] ABSTRACT

In the case of a device for detecting the spatial orientation of excessively heated points of wheel bearings and/or wheel running treads of rail vehicles, it is suggested that a deflecting device, such as an oscillating mirror 5, that can be varied periodically in its slope, be inserted into the path of the rays from a measuring point to a heat radiation sensor 7. The ray that is deflected when the slope of the deflecting device is changed can in this way also arrive on reflecting surfaces 10 for the purpose of autocollimation, thereby enabling an improvement in measuring precision. Radiation emitted from the detector is periodically reflected back onto the detector to provide a reference signal.

10 Claims, 3 Drawing Sheets

DEVICE FOR DETECTING THE SPATIAL ORIENTATION OF EXCESSIVELY HEATED POINTS

The invention relates to a device for detecting the spatial orientation of excessively heated points of wheel bearings and/or wheel running treads of rail vehicles, in which case a deflecting device, particularly a mirror or a rotating reflecting polygon, that is periodically variable in its slope, is arranged in a path of the rays from the measuring point to a heat radiation sensor.

BACKGROUND OF THE INVENTION

A number of prior art devices arranged in the track area are used to detect or locate an overheated wheel bearing. This type of a device is disclosed, for example, in DE-OS No. 29 07 945. In devices of this type, cooled detectors are used as heat radiation sensors.

In addition to the thermal detectors (such as bolometers) that are conventionally used as the detector, a group of rapidly responding heat radiation sensors exists, such as HgCd:HgTe, InSb, PbSe or combinations of these types of semiconductors. Semiconductor detectors of this type respond to changes by means of the thermal excitation of free charge carriers and are able to resolve a radiation of a high impulse sequence, but are not suitable for the continuous detection of a certain temperature level without additional devices, such modulators or deflecting devices that cyclically interrupt the incident ray or guide to other temperature levels.

Devices of this type are usually arranged in the track area, and the measuring ray reaches the generally cooled detector either vertically or in a direction deviating from the vertical line through a window of the device and corresponding deflection devices.

For a better calibration of devices of this type, it was suggested that the respective signal of the unknown source be compared with a reference source. Thus, for example, DE-OS No. 23 43 904 shows the aforementioned type of device wherein a reference source is housed in a pivotable lid which, after the passing-through of all wheels, could be swung into the path of the rays and in this way provided the detector with an additional reference signal. In the case of this known device, the standard emitter, in the waiting position of the system, was located in the path of the rays, whereas, during the measuring time, the signals of the standard emitter could not be taken into account because the lid that carried the standard emitter had to be swung to the side for the measuring.

Based on U.S. Pat. No. 2,978,859, it has become known to provide the detector intermittently with a standard emission along with an emission from an unknown source. In the case of this known device, a rotating disk-shaped modulator is provided, the axis of rotation of which is arranged in a sloped way with respect to the axis of the rays of an unknown emitter and to the axis of the rays of a standard emitter. In the case of an arrangement of this type, when a slotted disk is used, the temperature of the measuring point can always be detected when the slot exposes the path of the rays to the measuring point, and, when a wing of the modulator disk covers this path of the rays, a standard radiation source can be guided to the detector by reflection.

However, in every case, the known devices have always detected only one certain measuring point, and a temperature profile over a preferred direction of the measuring distance could not be measured in any way.

SUMMARY OF THE INVENTION

A main object of the invention is to supply information on the local position of the maximum temperature in addition to data on undue heating of measuring points for wheel bearings and/or wheel running treads, and to provide a particularly uncomplicated device by means of which the processing of equipment-internal temperature reference signals is made possible. This objective is achieved essentially by providing an autocollimation mirror element, the mirror surface of which faces the path of the rays coming from the heat radiation sensor and which, in at least one periodically recurring position of the periodically variable deflecting device, reflects the rays arriving from the heat radiation sensor back into the heat radiation sensor. Because of the fact that an autocollimation mirror element, in a periodically recurring way, is provided in the path of the rays coming from the heat radiation sensor and results in a self-image of the heat radiation sensor, a reference signal that differs clearly from the measuring value is periodically reflected onto the heat radiation sensor which represents the temperature of the cooled detector, whereby, on the one hand, an automatic calibration is made possible, and, on the other hand, a reduction of the background noise occurs, permitting a more precise signal evaluation. Because of the deflecting device, particularly the mirror, that is periodically changeable in its slope, the cone of vision can be moved over the measuring point and in this way can scan the measuring point along a preferred direction and take into account a plurality of consecutive measuring values in the case of real-time measurements. As a result, a temperature profile can be established directly that is corrected by means of the periodically measured reference signal, and by means of this type of a device, error occurring due to the sinusoidal path of wheels can be eliminated when measuring wheel bearings.

In a particularly uncomplicated way, the periodically variable deflecting device, in this case, may be constructed as an oscillating mirror and may be able to be swivelled around an axis that is in parallel to the reflection plane and/or is located in the reflection plane. An oscillating mirror of this type, for achieving a scanning speed that is adapted to the vehicle speed, can be excited with frequencies of several kHz in order to result in a scanning frequency which, during the relatively short time that is available for the measurement of a bearing, can actually carry out a detection at several points of a bearing. The evaluating electronic system or amplification circuit, in this case, must only meet the requirement that the electronic bandwidth is dimensioned in such a way that, even in the case of only one oscillation cycle, the rise time of the amplifier is sufficient for the evaluation of the full amplitude. Thus amplifiers must be used that have a relatively wide band.

Instead of an oscillating scanning mirror that moves the cone of vision in the form of lines over the object to be scanned, as an alternative, the construction may also be varied so that the mirror of the periodically variable deflecting device is formed by the sloped surfaces of a rotating disk, the slope of which, in the circumferential direction of the disk, is periodically different with respect to the plane of rotation, and the autocollimation mirror element is arranged at the circumference of the disk. By means of this type of a device, incremental changes of the slope of the reflecting plane can be implemented in a particularly simple way with a high frequency, in which case a continuous change would be possible if the slope of the reflecting circumferential surface were changed continuously with respect to the plane of rotation. However, the changing of the slope in increments by means of the side-by-side arrangement of differently sloped surfaces is much easier, whereby a certain scanning pattern can be indicated and the measuring precision can be increased.

In a simple way, according to the invention, the configuration, using either an oscillating mirror or a rotating mirror with a slope that changes in circumferential direction, is such that at the points of reversal of the movement of the rays reflected by the mirror, stationary autocollimation mirror surfaces are arranged that face the heat radiation sensor. Autocollimation mirror surfaces of this type that are arranged at the points of reversal of the movement of the scanning ray, in this case, constructed in a particularly uncomplicated way, reflect the temperature of the cooled detector back onto the detector so that a reference signal can be obtained that clearly differs from the measuring value and that can also particularly advantageously be used for the reduction of background noise. A construction may be used in which the stationary autocollimation mirror surfaces are arranged at a distance from the imaging lens system that corresponds to the refractive power of the imaging lens system, whereby it is ensured that a precise reference value is generated for the temperature at which the detector itself is located.

This type of autocollimation may be constructed for calibrating the arrangement by locating the stationary autocollimation mirror surface(s) at the edges of a field lens arranged in the focal plane and constructing them so as to be curved with a radius corresponding to the autocollimation. In order to ensure the required space for the housing of rotating or oscillating mirrors within the lens system, afocal systems may be inserted which, in the area of the mirror surfaces, result in a parallel path of the rays with a reduced cone cross-section.

BRIEF DESCRIPTION OF THE DRAWINGS

In the following, the invention is described in detail by means of embodiments shown in the drawings.

DESCRIPTION OF THE PREFERRED EMBODIMENTS

Figure 1:
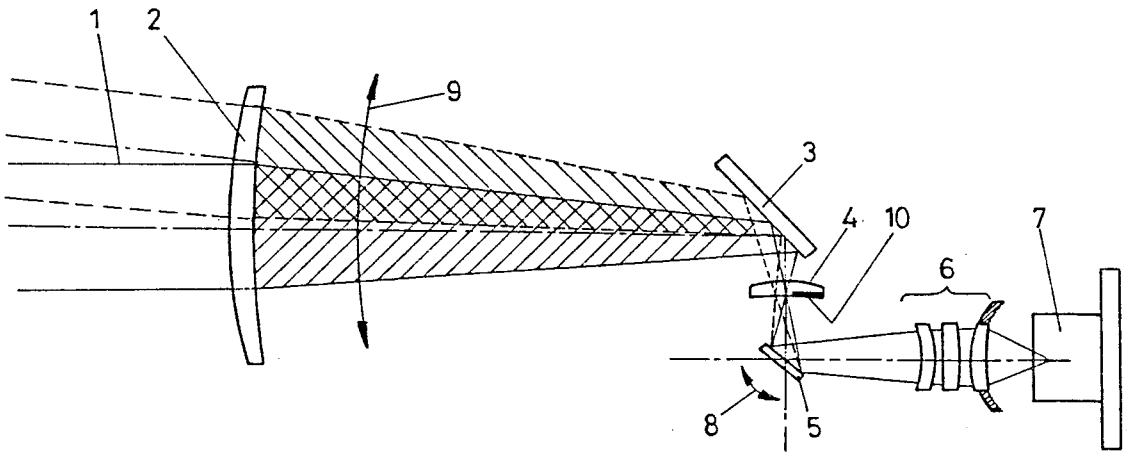
FIG. 1 is a first diagrammatically represented arrangement of the path of the rays with an oscillating mirror and autocollimation by means of vaporized surfaces of a field lens.

In the case of the construction shown in FIG. 1, the measuring ray 1, via a focussing optical element 2, reaches a deflecting mirror 3, and subsequently, with the insertion of an image field lens 4, reaches an oscillating mirror 5 which guides the image scanned at the image field lens 4, via an infrared lens system 6, to a detector or heat radiation sensor 7. In this case, the oscillating mirror 5 swings in the direction of the double arrow 8, and for carrying out this oscillation, may be excited piezoelectrically via oscillator crystals or electromagnetically.

At its side facing the mirror, the field lens 4 has a radius of curvature that corresponds to the refractive power of the convergent lens(es) of the infrared lens system 6. By means of the swivel motion of the mirror 5, on the one hand, a visual range is detected that is swept corresponding to the double arrow 9, and on the other hand, the image of the detector 7 that was drawn by the convergent lens of the infrared lens system 6, with a correspondingly wide deflection, reaches vaporized areas provided in the edge area of the convergent lens. The image of detector element 7 is reflected in these edge areas, thereby making available a reference signal for that element's temperature. The detector element itself may be simply, thermoelectrically cooled. The autocollimation, in this case, is achieved by the reflectingly vaporized areas of the field lens 4 which have the reference number 10. Since it is known that small images on lens surfaces, because of possible inhomogeneities, are critical, the lens may also be arranged slightly outside the photo. However, in the present case, because of the deflected ray, even in the case of inhomogeneities, only a small additional modulation may occur that is insignificant for the formation of references.

Figure 2:
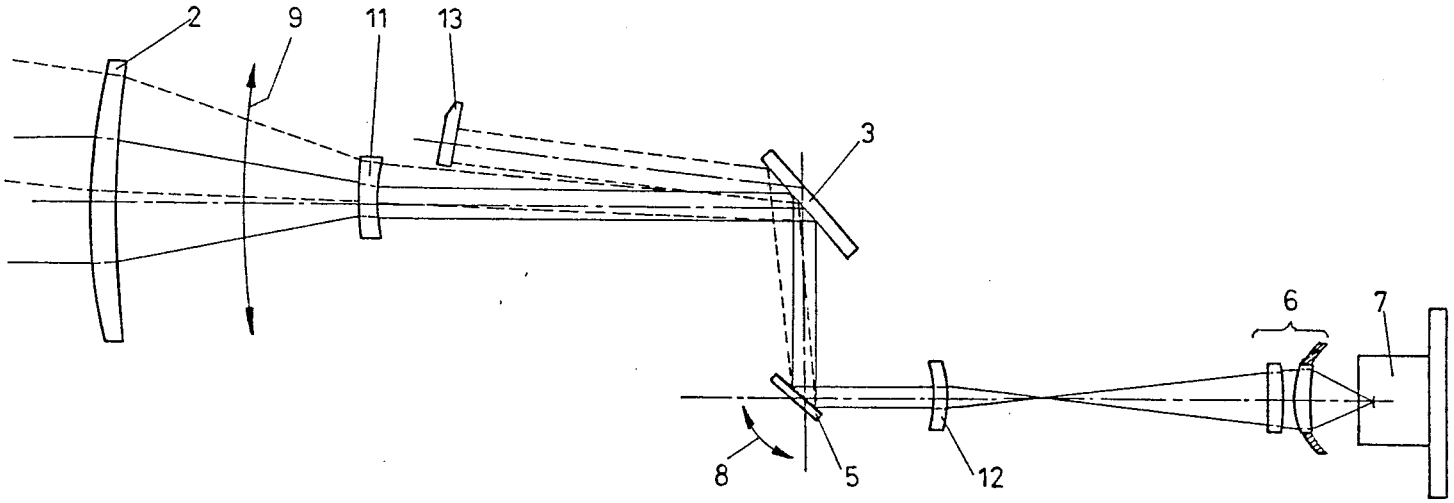
FIG. 2 is a modified development with planar autocollimation mirrors.

In the case of the embodiment according to FIG. 2, an afocal system is provided in front of the detector 7 between the lens system 2 on the inlet side and the infrared lens system 6. This afocal system consists of a divergent lens 11 and a convergent lens 12, the refractive powers of which cancel one another so that a dislocation of the focal point away from the objective takes place. This dislocation makes it possible to draw out the optical arrangement and provides the required space for the mounting of an oscillating mirror 5. The deflecting mirror in this case again has the number 3. Since in the area between the divergent lens 11 and the convergent lens 12, the path of the rays extends in parallel with a reduced cone cross section, an autocollimation mirror with a plane surface may be arranged outside the divergent lens 11. This autocollimation mirror with the plane surface has the number 13. By means of the swivel motion of the mirror in the direction of the double arrow 8, in turn, a visual field widening takes place in the direction of the double arrow 9.

Figure 3:
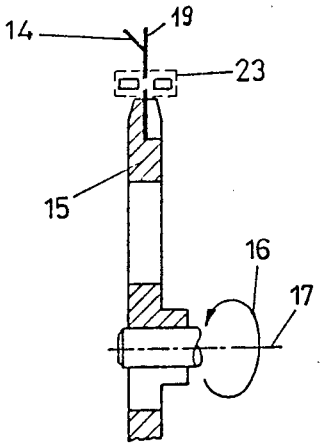
FIG. 3 is an axial sectional view of a rotating mirror replacing the oscillating mirror according to FIG. 2.

Instead of the oscillating mirror 5 in the construction according to FIGS. 1 and 2, a rotating disk corresponding to FIG. 3 may also be used, which has sloped mirror surfaces 14 at its outer circumference. The rotating disk has the reference number 15 and may be rotated in the direction of the arrow 16 around the axis of rotation that has the number 17. In the case of the representation according to FIG. 3, a light barrier 23 is provided that can furnish synchronization signals to the evaluating electronic system that follows.

Figure 5:
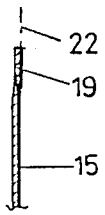
FIGS. 5, 6 and 7, are sectional views according to Lines V—V, VI—VI and VII'VII of FIG. 4.

The mirror surface that has the reference number 19 in FIG. 3, in this case, extends in the plane 22 of rotation of the disk 15, as shown in detail in FIG. 5, and serves as the autocollimation mirror surface of the disk 15 which periodically, when the disk 15 is rotated, enters into the path of the rays coming from the heat radiation sensor 7 and results in a periodic self-image of the detector 7 for the generating of a periodic reference signal.

Figure 4:
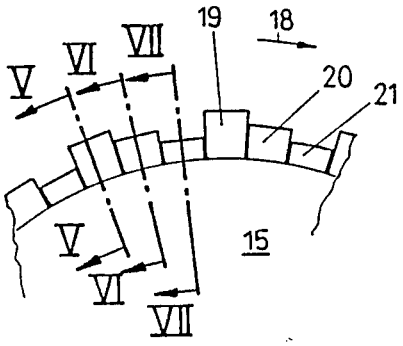
FIG. 4 is a view of a rotating mirror according to FIG. 3 in axial direction.
Figure 6:
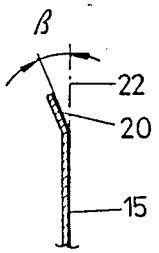
Figure 7:
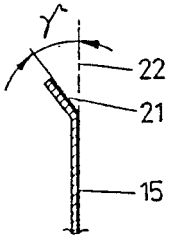

The development of the outer circumference of the rotating disk is shown in detail in FIGS. 4 to 7. In order to create a cyclical change of the slope of the mirror and thus a situation that is comparable to an oscillating mirror, mirror surfaces 20 and 21 that follow one another in circumferential direction 18 corresponding to FIG. 4 are arranged with a varying slope with respect to the plane of rotation of the disk. The change of the slope, in this case, takes place incrementally, but it is also easily possible to carry out a continuous change of the slope which, however, over the circumference, would have to have at least one point of discontinuity. The varying slopes of the individual mirror surfaces 20 and 21 are shown in FIGS. 6 and 7 and are represented by the angles and with respect to the plane 22 of rotation.

For a more precise examination, several mirror surfaces with a varying slope with respect to the plane 15 of rotation could naturally be arranged in a periodically returning way at the circumference of the disk 15, in which case an approximation to a continuous change of the slope to the desired extent can be achieved by using a corresponding number of mirror surfaces of a varying slope.

I claim:

1. A device for detecting the spatial orientation of excessively heated points of wheel bearings and/or wheel running treads of rail vehicles comprising deflecting means, said deflecting means receiving radiation from said wheel bearings and/or wheel running treads, said deflecting means being periodically changeable in its slope and being arranged in a path of rays from a measuring point to a heat radiation sensor (7), characterized in that an autocollimation mirror element (10), (13), (19) is provided, the mirror surface of which faces the path of rays coming from the heat radiation sensor (7), and, in at least one periodically recurring position of the periodically changeable deflecting means, the rays arriving from the heat radiation sensor (7) are reflected back into said heat radiation sensor (7).

2. A device according to claim 1, characterized in that the periodically changeable deflecting means is developed as an oscillating mirror (5) and can be swivelled around an axis that is located in parallel to the reflection plane and/or in the reflection plane.

3. A device according to claim 2, characterized in that the autocollimation mirror element (10, 13) is stationary and arranged to face the heat radiation sensor (7) at the points of reversal of the movement of the rays reflected by the oscillating mirror (5).

4. A device according to claim 3 characterized in that the autocollimation mirror element is arranged at a distance from an imaging lens system (6) which corresponds to the refractive power of the imaging lens system.

5. A device according to claim 4, characterized in that the stationary autocollimation mirror element (10) is arranged at the edges of an image field lens (4) and is developed to be curved with a radius corresponding to the refractive power with respect to the autocollimation.

6. A device according to claim 1, characterized in that the periodically changeable deflecting means is formed by sloped surfaces (14), (20), (21) of a rotating disk (15) the slope of which, in circumferential direction of the disk (15), is periodically different with respect to the plane of rotation and in that the autocollimation mirror element (19) is arranged at the circumference of the disk.

7. A device according to claim 6, characterized in that the autocollimation mirror element is arranged at a distance from an imaging lens system (6) which corresponds to the refractive power of the imaging lens system.

8. A device according to claim 1, characterized in that the autocollimation mirror element (10, 13) is stationary and arranged to face the heat radiation sensor (7) at the points of reversal of the movement of the rays reflected by the deflecting means.

9. A device according to claim 8, characterized in that the autocollimation mirror element is arranged at a distance from an imaging lens system (6) which corresponds to the refractive power of the imaging lens system.

10. A device according to claim 9, characterized in that the stationary autocollimation mirror element (10) is arranged at the edges of an image field lens (4) and is developed to be curved with a radius corresponding to the refractive power with respect to the autocollimation.

* * * * *